United States Patent [19]

Gutentag

[11] 4,399,910

[45] Aug. 23, 1983

[54] JEWELRY RETAINING MEANS INCLUDING COMPENSATION MEANS FOR DIMENSIONAL VARIATIONS IN OBJECTS RETAINED THEREIN

[75] Inventor: Charles Gutentag, Los Angeles, Calif.

[73] Assignee: Tempo G, Los Angeles, Calif.

[21] Appl. No.: 328,722

[22] Filed: Dec. 8, 1981

[51] Int. Cl.[3] ..... B32B 3/10

[52] U.S. Cl. ..... 206/0.82; 220/319; 40/156; 40/157; 40/27.5; 40/10 R; 40/323; 428/14; 428/66; 428/138

[58] Field of Search ..... 206/0.82, 0.8; 40/156, 40/157, 27.5, 10 R, 323; 63/29 R, 18; 248/27.3, 441 A; 428/13, 14, 28, 64, 65, 138, 137, 66; 220/319

[56] References Cited

U.S. PATENT DOCUMENTS 4,063,639 12/1977 Grant ..... 206/0.82
4,283,831 8/1981 Jhono ..... 264/221 X

*Primary Examiner*—Alexander S. Thomas
*Attorney, Agent, or Firm*—Thomas I. Rozsa

[57] ABSTRACT

An improved frame design for retaining a coin, medallion and other jewelry objects wherein a frame of one standard size can accommodate similarly shaped objects within a range of differing thicknesses. An improved shim which allows a standard size frame to accommodate similarly shaped objects whose perimeter dimensions are small enough so that the object can move inside the frame. An improved retaining ring which serves to impede the rotation of a circular object inside a cylindrical frame.

11 Claims, 10 Drawing Figures

JEWELRY RETAINING MEANS INCLUDING COMPENSATION MEANS FOR DIMENSIONAL VARIATIONS IN OBJECTS RETAINED THEREIN

BACKGROUND OF THE INVENTION

The present invention relates to specific apparatus improvements in ornamental frames for retaining objects such as coins or jewelry and which can be worn by individuals as a decorative accessory to their attire or as an accessory to other items such as a key chain. More particularly, the present invention relates to the addition of an improvement which is incorporated within the metal retaining frame to allow one frame to accommodate similar objects such as numismatic coins or medallions which are of slightly different size such as different thickness, width, length, or circumference.

U.S. Pat. No. 4,283,831 issued to Jhono discloses an apparatus and frame design for retaining jewelry of precise dimensions. FIGS. 12 through 18 in that patent disclose the design for a frame wherein the piece of jewelry or coin is retained within the upper portion of the frame and is locked therein by one or more retaining rings which are inserted into an annular groove located within the frame wall and below the area where the coin or medallion is retained. An object of the invention in that patent was to create a frame which would hold precise dimensions in specific areas so that jewelry or coins manufactured to precise dimensions could be securely held within the frame. Therefore, the upper portion of the frame which encircled the coin or medallion was precisely designed to accommodate a specific size coin or medallion. Additionally, the annular groove within the frame was designed to be substantually 90 degrees overall and substantially 45 degrees from the horizontal, with the upper and lower walls being smoothly sloped. This design achieved the advantage of having a proper resolution of forces of the retaining wire so that approximately half of the force was directed upward to retain the coin or medallion and approximately half the force was directed outward to support the retaining wire within the annular groove.

The invention as disclosed in U.S. Pat. No. 4,283,831 is excellent for retaining bullion coins of current issue such as Krugerrands which are normally uncirculated prior to mounting and therefore have fairly precise and consistent dimensions from one coin to the other. It has become popular to wear circulated numismatic coins as a jewelry item. Examples are United States gold coins of the nineteenth and early twentieth centuries. Many discontinued numismatic coin types, especially gold coins, were generally minted over a number of years and at more than one mint location. This resulted in subtle changes in the coins, some of which resulted in dimensional changes. Most typically the variation resulted in differing thickness at the rim edge of the coin, even though the basic coin design and its official type designation were the same.

Even when using uncirculated or protected proof coins, one cannot except the dimensions of each coin to be exactly the same. The principal criteria for minting coins of precious metal (especially gold) was the maintenance of precise weight rather than precisely uniform dimensions during the years of issue for each official type of coin. In the making of new coining dies to replace worn or broken die sets or to incorporate subtle variations such as date changes and mint markings, it became necessary to adjust the die set during final finishing by the engraver to accommodate the precise volume of metal contained in the coining blank or planchet. Typically, this adjustment was accomplished by varying the thickness at the rim edge of the coining die set and the resulting coins produced therefrom. Therefore, most reference texts which provide detailed descriptions and specificaions for numismatic coinage either omit coin thickness dimensions altogether, or use the term "various" or "variable" when defining the edge thickness or thickness at the rim for many precious metal coin types. Therefore, a manufacturer of frames cannot manufacture one frame of precise dimensions and expect to accommodate the multiplicity of variations in the numismatic coins.

Further, if used coins are employed in the jewelry frame, the common wear on the coin during use will create a multiplicity of dimensional variations in the coin thickness and/or in perimeter dimensions such as diameter, circumference, length and width. Therefore, while the invention as described and disclosed in U.S. Pat. No. 4,283,831 is excellent for retaining objects of precise dimensions, its ability to retain objects of varying dimensions is severely limited. If the thickness of the coin is too great or too thin, the retaining ring cannot effectively retain the object within the frame. If the perimeter dimensions are undersize, the coin or medallion will most likely move or rotate freely within the frame. Therefore, the known prior art does not disclose an apparatus whereby a multiplicity of dimensional variations in the object to be retained can be accommodated by a single retaining frame size.

SUMMARY OF THE INVENTION

The present invention relates to an improved jewelry retaining means which includes within its design means for compensating for dimensional variations in the objects retained therein. The frame utilized in the present invention is not restricted to any specific size and is applicable to frames of all shapes such as circular, square, rectangular, oval, heart shaped, and polygonal (hexagonal, octagonal, pentagonal, etc.). Furthermore, the present invention can be incorporated into any number of manufacturing methods for the retaining means or frame such as investment casting, machining, stamping, die-striking, and extrusion.

The present invention relates to an improved jewelry frame wherein the object to be retained is placed in the upper portion of the frame and is retained therein by one or more locking rings which fit into an annular groove located in the interior wall of the frame directly beneath the area surrounding the object to be retained.

The present invention further relates to an improved frame for holding an object in its upper portion so that the upper face of the object shows through an opening in the upper surface of the frame and for retaining the object in place by means of an open ended resilient prestressed retaining wire having a round cross-section which exerts a centrifugal force when inserted into a groove which extends along the entire inner circumferential wall along the lower portion of the frame whereby a vertical force component from the open ended prestressed retaining wire against the lower surface and/or lower perimeter area of the object serves to retain the object in place and a horizontal force component from the open ended retaining wire serves to retain the wire within the groove in the lower portion of the inner frame wall.

The present invention incorporates the use of one or more corrugated flexible shims which can be removably placed in the area between the perimeter of the object to be retained and the interior wall of the frame which surrounds the object, in order to compensate for objects which have become worn or are otherwise undersize and whose perimeter is small enough so that the object could move or rotate freely within the frame.

The present invention also incorporates the use of an improved retaining ring design for circular shaped retaining rings, to further impede rotation of a round object such as a coin or medallion which has been mounted in the frame. The improved design consists of a lightly knurled or roughened surface on the circular retaining ring used to retain a circular object within the frame. When installed the roughened surface of the retaining ring bears against the normally smooth rim edge of the circular coin or medallion and serves to impede rotation due to added friction.

The present invention also describes and defines a generic configuration or geometry for the groove located within the inner wall of the retaining means shaped to serve as a frame or mounting for the object such as die struck coins or medallions. The locking means to retain the object within the frame consists of one or more retainers made of round spring wire which have been conformed under preload to the general perimeter shape and size of the object to be mounted. The present invention incorporates a generic configuration or geometry for the groove which will automatically position the retainer(s) against the perimeter surface of the object being mounted and will simultaneously vector a portion of the spring preload against said perimeter surface of the object to secure its position within the frame or mounting, while another vector portion of the spring preload will serve to secure the retainer(s) within the groove, thereby comprising an ideal means for securing and maintaining objects of varying thickness within a frame or mounting of standard interior dimensions.

It has been discovered, according to the present invention, that it is possible to accommodate similar objects of different thickness in a retaining frame having a fixed interior wall size or dimension provided that the position of the locking mechanism supporting and retaining the object within the frame can be adjusted to accommodate the difference thicknesses. It has been discovered that if the locking mechanism is a spring retaining wire, the locking mechanism position can be adjusted if the groove which accommodates the retaining ring or wire(s) has a height substantially greater than the diameter of the spring retaining wire and the groove has a smooth sidewall which is tapered along the height of the groove wherein the groove is at a uniform angle such that its deepest point is adjacent its uppermost portion. The desired slope of the angle is dependent upon the range of thickness variations of objects to be accommodated within the frame and the desired spring load force necessary to be applied to the perimeter surface and/or lower surface of the object to be retained in the frame or mounting. The lower wall edge of said groove furthest removed from the retained object should be substantially straight and substantially horizontal, and extend for a length at least approximately equal to 10 percent of the diameter of said open ended prestressed retaining wire.

It has also been discovered, according to the present invention, that if the deepest point of the groove is at its uppermost portion and immediately adjacent to the object to be mounted, the spring retaining wire will be automatically positioned firmly against the lower surface of the object being mounted. Simultaneously, the spring retaining wire will apply a vectored portion of the spring preload force against the object to hold the object securely within the frame or mounting, and will further serve to impede rotation of circular objects (such as coins) within the frame or mounting. Therefore, by having this sloping annular groove design where the deepest portion of the groove is at its uppermost portion, the spring retaining wire(s) will expand to their maximum dimension when loaded into the sloped groove due to spring load forces, which serve to automatically locate the retainer(s) at the deepest and highest accessible portion of the groove which is immediately adjacent to and against the lower surface of the object being mounted.

It has further been discovered, according to the present invention, that if the inner side wall edge of the annular groove furthest removed from the object being mounted is straight, substantially horizontal and at a 90 degree angle to the inner wall of the frame or mounting which the annular groove circumscribes, and that if said straight side wall penetrates the frame or mounting such that it extends for a depth equal to approximately 10 percent of the diameter of the spring wire retainer(s) of round cross-section to be employed, thereby constituting the minimum depth portion of the groove, then heavy pressure applied against the obverse side of the object in an attempt to force the object out of the frame or mounting will not dislodge the wire retainer(s) and allow the object to escape from the frame, provided that wire retainer(s) have been presized to cause the open ends of same to abut when the retainer(s) are compressed to the point where forced against the aforesaid straight side wall of the groove.

It has additionally been discovered, according to the present invention, that both the width and the angular slope of the bottom of the groove must be dependently proportioned to accommodate the preprogrammed range of edge thickness variations of objects intended for mounting. It has been discovered that the minimum effective penetration of the spring wire retainer(s) of round cross-section within the groove must be approximately 25 percent of the round spring wire diameter and that the maximum effective penetration of the retainer(s) within the groove is approximately 75 percent of the diameter of the spring wire in order to serve as a functional retaining means for the object. It is therefore apparent that the effective range of working depths of the retainer(s) is approximately 50 percent of the diameter of the spring wire retainer(s) being utilized.

It has also been discovered, according to the present invention, that variations in perimeter dimension(s) such as diameter, length, or width of objects to be mounted in a frame or mounting of single standard dimensions can be compensated for by use of a special single shim, formed in a wavy, corrugated pattern and made of spring metal, such that the effective working dimension of the shim is widely variable to compensate for a range of variations which may be encountered in undersize perimeter dimension(s) of an object to be mounted within the fixed perimeter of a standard frame or mounting. Whereas the perimeter dimension(s) of the frame or mounting are standardly sized to receive objects at the maximum end of the preprogrammed size range, the shim is employed in those instances where objects of less than maximum perimeter dimension(s) are to be mounted. Because it is extremely undesirable to mount an object in a frame or mounting where the object is loosely held and is free to move after the installation is complete, it is therefore desireable to assure a snug fit between the perimeter dimension(s) of the frame or mounting and the object to be installed therein. Whereas conventional shimming techniques involve the use of a series of shim stock, often of varying thicknesses to compensate for the specific dimensional differences encountered in each particular installation, the present invention incorporates a single shim of special design to accommodate a full preprogrammed range of dimensional variations between perimeter dimension(s) of standard sized frames or mountings and the particular dimension(s) of the object or objects which these frames and mounting are designed to receive.

It has further been discovered, according to the present invention, that in a circular frame having a circular retaining wire, the normally smooth rim edge surface of the coin or dedallion will often allow rotational movement of the object relative to the smooth surface of the retaining wire. It has therefore been discovered that if the surface of the circular retaining wire of round cross-section is roughened or knurled, a friction barrier is achieved which will further impede rotational movement of the circular coin or medallion within the frame.

It is therefore an object of the present invention to provide an improved jewelry retaining means which includes within its design means for compensating for dimensional variations in the objects to be retained therein. It is an object of the present invention to provide a frame which can be mass produced in a single size and design, and which can accommodate similarly shaped objects of various thicknesses.

It is another object of the present invention to provide an improved shim design which incorporates the use of one or more corrugated shims which can be removably placed in the area between the perimeter of the object to be retained and the interior wall of the frame which surrounds the object, in order to compensate for objects which have a diameter or perimeter which is slightly too small for the frame.

It is a further object of the present invention to provide an improved retaining ring design for circular shaped retaining rings, to further impede rotation of circular objects when mounted within a frame.

Further novel features and other objects of the present invention will become apparent from the following detailed description and the appended claims taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

The present invention relates to specific apparatus improvements in ornamental frames for retaining objects such as coins or jewelry and which can be worn by individuals as a decorative accessory to their attire. More particularly, the present invention relates to the addition of improvements which are incorporated within the metal retaining frame to allow one frame size to accommodate similarly shaped objects such as numismatic coins or medallions which are of slightly different thicknesses. The invention also incorporates an improved shim design which compensates for slight, undersize differences in diameter, width, or length of the object to be retained within the frame. The invention also encompasses an improved design for the circular retaining ring to impede rotational movement of a circular object mounted within a frame.

The present invention relates to an improved frame for holding an object in its upper portion so that the upper face of the object shows through an opening in the upper surface of the frame and for retaining the object in place by means of an open ended resilient prestressed retaining wire having a round cross-section which exerts a centrifugal force when inserted into a groove which extends along the entire inner circumferential wall along the lower portion of the frame whereby a vertical force component from the open ended prestressed retaining wire having a round cross-section against the lower surface and/or lower perimeter area of the object serves to retain the object in place and a horizontal force component from the retaining wire serves to retain the wire within the groove in the lower portion of the inner frame wall.

Figure 1:
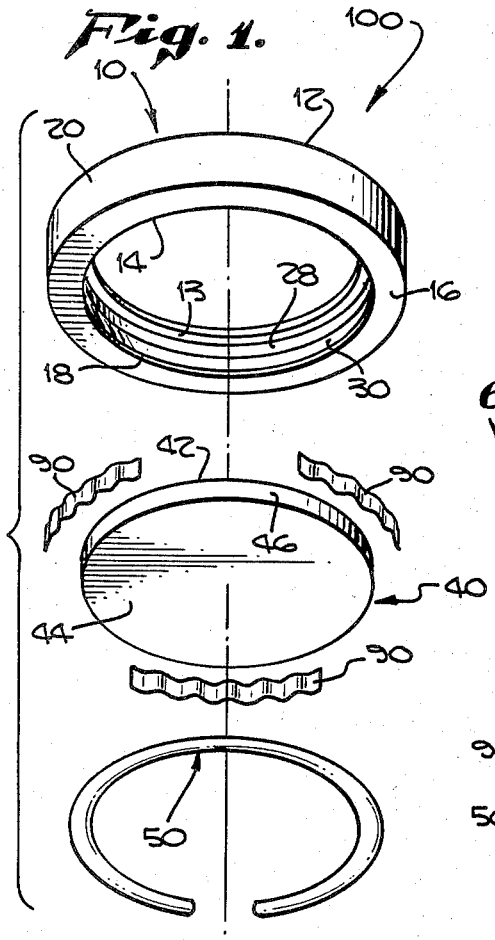
FIG. 1 is an exploded perspective veiw of the retaining frame and its elements including the retained object, perimeter shims, and retaining ring, from a bottom elevational view.

With reference to the drawings of the invention in detail and more particularly to FIG. 1, all of the elements of the ornamental item 100 are shown in an exploded perspective view. Although the following discussion deals with items of generally circular configuration, it is emphasized that this is in no way intended to limit the present invention to circular items. The following discussion is also intended to emcompass items of many other configurations, including but not limited to square, rectangular, oval, heart shaped, polygonal (hexagonal, octagonal, pentagonal,) etc.

Referring again to FIG. 1, the frame is shown at 10. The frame 10 contains an upper face 12 having a central hole 14 and a lower face 16 having a large central hole 18. The frame 10 also contains an outer transverse circumferential wall 20 perpendicular to both the upper face 12 and the lower face 16. The frame also contains an inner transverse circumferential wall 26 which in turn contains a critical dimension inner wall 28 being only slightly larger than the maximum original size of the coin or medallion to be retained within it and a three hundred sixty (360) degree groove 30 running beneath the critical dimension inner wall 28 and within inner transverse circumferential wall 26. The upper face 12 contains an inner lower surface 13.

The coin or medallion which is held within the frame 10 is shown at 40. The coin or medallion 40 contains an upper face 42, a lower face 44 and a perimeter 46. The coin or medallion 40 is inserted into the frame 10 such that the coin's upper surface 42 shows through upper hole 14 in the frame 10 and the outermost portion of the upper face or surface 42 rests against inner lower surface 13 of the frame 10. The perimeter 46 of the coin 40 is surrounded by the critical dimension inner wall 28 of the frame 10.

The coin or medallion 40 is retained in place inside the frame 10 by a resilient prestressed wire or ring 50 which fits within the groove 30. The resilient prestressed retaining wire 50 is prestressed so that it exerts a centrifugal outward force, a portion of which is directed vertically to retain the coin 40 within the frame 10, and a portion of which is directed horizontally to keep the retaining wire 50 within the groove 30.

The above described elements are all disclosed in U.S. Pat. No. 4,283,831 issued to Jhono. The present invention relates to significant improvements in elements of frame 10 and additional supporting means. As previously discussed, the invention in U.S. Pat. No. 4,283,831 was designed to create a frame which would hold precise dimensions in specific areas so that medallions, jewelry or coins manufactured to precise dimensions could be securely held within the frame. That invention was applicable for retaining items where the dimensions of the object to be retained could be predicted with accuracy and would be consistent from one item to the next. The present invention relates to improvements which permit the frame 10 to accommodate a multiplicity of similarly shaped objects where the exact dimensions are not readily predictable and are not exactly consistent from one item to the next. As previously discussed, it has become popular to wear circulated numismatic coins as a jewelry item. Examples are United States gold coins of the nineteenth and early twentieth centuries. Many discontinued numismatic coin types, especially of gold coins, were generally minted over a number of years and at more than one location. This resulted in subtle changes in the coins, some of which resulted in dimensional changes. Most typically, the variation resulted in different thicknesses at the rim edge of the coin, even though the basic coin design and its official type designation were the same. In addition, the majority of numismatic coins of precious metal used for jewelry have been circulated and thus subjected to wear, resulting in some reduction of original edge thickness and perimeter dimensions.

Therefore, in designing a frame 10 for an object to be retained where each object will be of similar shape but where the thickness cannot be precisely predetermined from one object to the next, the invention in U.S. Pat. No. 4,283,831 is limited in its application. An improvement in the present invention is one that will allow one frame to accommodate objects of widely varying thicknesses. This is accomplished by defining a generic configuration or geometry for the groove 30 which is substantially different from the V shaped annular groove in U.S. Pat. No. 4,283,831. The present invention incorporates a generic configuration or geometry for the annular groove 30 which will automatically permit said open ended resilient prestressed retaining wire 50 to position itself against the lower surface 44 at or near perimeter 46 of the coin or medallion 40 being mounted and will permit said open ended resilient prestressed retaining wire 50 to simultaneously vector a portion of the spring preload against said coin or medallion 40 to secure its position within the frame or mounting. Another vector portion of the spring preload will serve to secure the retainer 50 within the annular groove 30. This invention therefore comprises an ideal means for securing and maintaining objects of varying thickness within a frame or mounting of standard interior dimensions.

Figure 4:
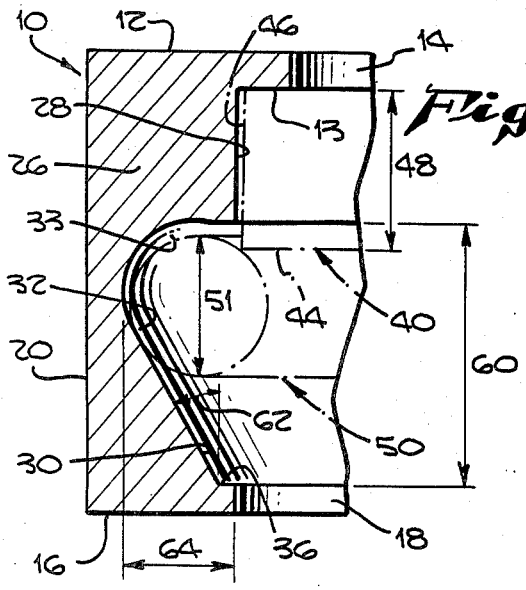
FIG. 4 is a fragmentary enlarged sectional view of the retaining frame, with retained object, and retaining wire shown in phantom.

The improved design for the improved groove 30 is best illustrated in the fragmentary enlarged sectional view of FIG. 4. The height 60 of the groove 30 must be substantially greater than the diameter 51 of the spring retaining wire 50. Preferably, the height 60 of the groove 30 should be at least twice the diameter 51 of the retaining wire 50. This will enable the retaining wire 50 to adjust itself along the height 60 of the groove 30 in order to compensate for varying thicknesses 48 in the objects to be retained 40. Instead of having a V shaped groove as in U.S. Pat. No. 4,283,831, the groove 30 of the present invention is both smooth and uniformly tapered throughout its circumscribed area and at a uniform angle. For purposes of the present discussion, the angle 62 is defined relative to the vertical. The desired slope of the angle 62 is dependent upon the range of thickness of objects to be accommodated within the frame 10 and the desired spring load force necessary to be applied to the lower surface 44 at or near perimeter 46 of the coin or medallion 40.

The slope of the groove 30 must be such that the deepest point 32 of the groove 30 is adjacent its uppermost portion 33 and immediately adjacent the object to be mounted 40. For manufacturing efficiency, the uppermost portion 33 of the groove 30 is relieved and therefore the deepest point 32 is not exactly at the uppermost portion 33 of the groove 30. The relieved area also assures that the retaining wire 50 is not restricted by the frame 10 in the wire's ability to retain the object 40 within the working dimensions of the groove height 60. The retaining wire 50 does not usually go up against the maximum end at the relief area, thereby assuring that the retaining wire 50 does not bottom out prematurely. It is desirable to have the deepest portion 32 as close to the uppermost portion 33 as possible. By having this sloping groove design where the deepest portion 32 is as close as possible to the uppermost portion 33, the spring retaining wire 50 will expand to its maximum dimension when loaded into the sloped groove 30 due to the spring load forces previously described which serve to automatically locate the retaining wire 50 at the deepest and highest accessible portion of the groove 30 which is immediately adjacent to and against the lower surface 44 at or near the perimeter 46 of the coin or medallion 40.

Figure 5:
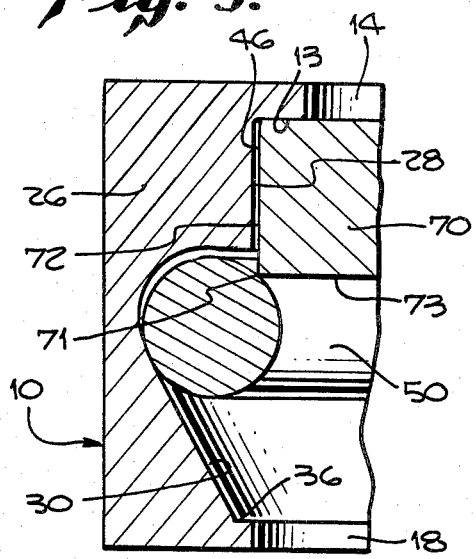
FIG. 5 is a fragmentary enlarged sectional view of the assembled apparatus, without use of a shim. A thin object is retained therein and the angle of the groove from the vertical is 30 degrees.
Figure 6:
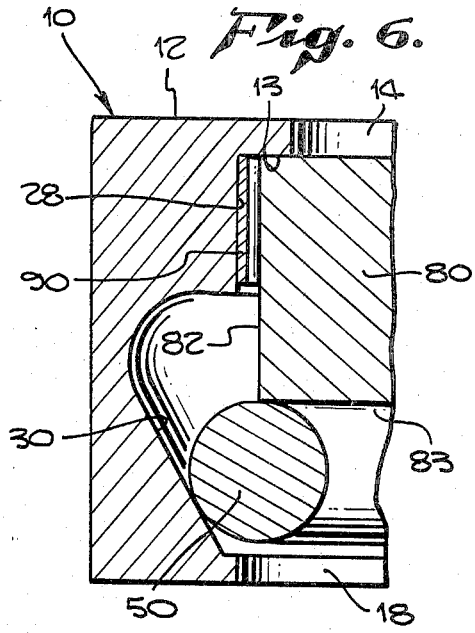
FIG. 6 is a fragmentary enlarged sectional view of the assembled apparatus, taken along line 6—6 of FIG. 2. A thick object is retained therein and the angle of the groove from the vertical is 30 degrees.

By having this groove 30 with a smooth side wall which is tapered along the height of the groove wherein the groove is at a uniform angle such that its deepest point is adjacent its uppermost portion, a multiplicity of coin or medallion thicknesses 48 can be accommodated within the same frame or retaining means 10 design and size. For example, the thickness variation can be as much as 20 percent of object thickness 48. This is illustrated in FIG. 5 and FIG. 6 where the same frame 10 with the same slope angle 62 (which is 30 degrees) is used to accommodate a thin coin or medallion 70 shown in FIG. 5 and a thick coin or medallion 80 shown in FIG. 6. For a thin coin or medallion 70, most of the medallion is located within the area of the critical dimension inner wall 28 and very little extends into the area surrounded by the groove 30. The retaining ring 50 is threfore allowed to expand to the maximum working depth of the groove 30, and is able to retain the thin coin or medallion 70 with most of the force at its corner 71 such that force is divided between the lower perimeter 72 and the lower surface 73. In the case of the thick coin or medallion 80 shown in FIG. 6, only a portion of the thickness is occupied within the area of the critical dimension inner wall 28 and a significant portion of the thickness extends into the area surrounded by the groove 30. The present invention therefore allows the retaining ring 50 to compensate for this and the retainer 50 is much futher down along the slope of the groove 30. As a result, the retaining wire 50 primarily exerts its vectered force against the lower surface 83 of the thick coin or medallion 80 and no force is exerted against the perimeter 82.

As seen in FIG. 4, both the height 60 and the angular slope or angle 62 of the groove 30 must be dependently proportioned to accommodate the preprogrammed range of edge thickness 48 variations of objects 10 intended for mounting. It has been discovered that the minimum effective penetration of the open ended resilient prestressed retaining wire 50 within the groove 30 must be approximately 25 percent of the open ended spring wire retainer round cross-sectional diameter 51. If penetration is substantially less than 25 percent, there will not be a sufficient horizontal force component to retain the wire 50 within the groove 30. It has also been discovered that the maximum effective penetration of the open ended resilient prestressed spring wire retainer 50 within the groove 30 is approximately 75 percent of the round cross-sectional diameter 51 of the wire 50. If penetration is substantially greater than 75 percent the round spring wire retainer 50 will not contact the surface of nor serve to retain the coin or medallion 40 within the frame 10. It is therefore apparent that the effective range of working depths of the retainer 50 is approximately fifty percent of the diameter 51 of the round cross-sectional spring wire being utilized.

Figure 7:
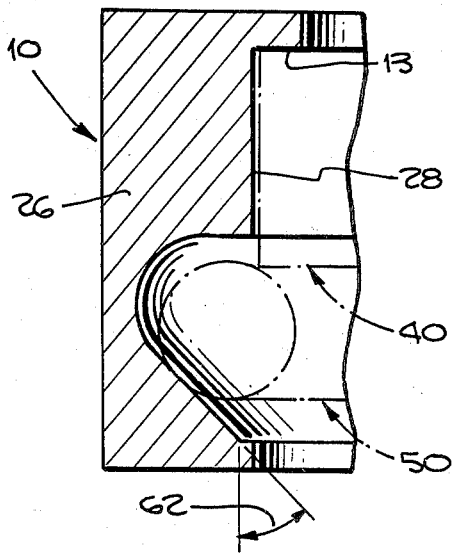
FIG. 7 is a fragmentary enlarged sectional view of the assembled apparatus, without use of a shim. The angle of the groove from the vertical is 45 degrees.
Figure 8:
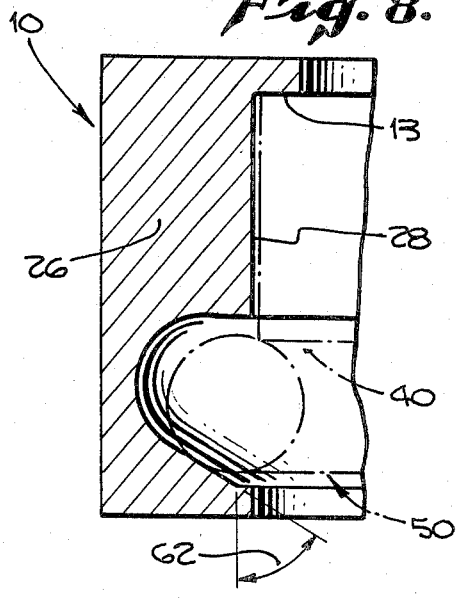
FIG. 8 is a fragmentary enlarged sectional view of the assembled apparatus, without use of a shim. The angle of the groove from the vertical is 60 degrees.

The other variable component in addition to the retainer wire diameter 51 is the angle 62 or slope of the groove 30. It has been discovered that the most effective range of angular slope 62 for the groove 30 is between approximately thirty degrees and approximately sixty degrees from the vertical. The optimum angular slope 62 is forty five degrees. The present invention utilizing an angular slope or angle 62 of forty five is shown in FIG. 7. The present invention utilizing an angular slope or angle 62 of sixty degrees is shown in FIG. 8. A forty five degree angle results in approximately equal vectored forces of the total spring load of the retainer 50, with about fifty percent of the load applied directly against the surface of the object being retained and the remaining spring load force serving to hold the retainer 50 within the groove 30. A forty five degree angular slope at the bottom of the groove 30 provides a total range of edge thickness variations of objects to be mounted equal to approximately forty percent of the diameter 51 of the round spring wire 50 employed. The retainer 50, moving along a forty five degree angle at the bottom of the groove 30, will penetrate the groove 30 at the same distance rate as movement occurs toward the object of minimum thickness to be retained, until fifty percent of groove penetration is attained. Thereafter, the point on the inner-most half of the diameter of the round wire retainer 50 which will contact the perimeter 46 of the object 10 being retained advances as a negative radius, until the approximate 75 percent maximum effective penetration of the retainer 50 within the groove 30 is reached.

Whereas a lesser slope angle 62 at the bottom of the groove 30 (for example thirty degrees) would expand the range of edge thickness variations for objects to be mounted within a frame or mounting of given wall thickness, the resulting reduction of spring load vectored force of the retainer bearing against the surface of the object could create a loose or sloppy mounting for an object at or very close to the minimum edge thickness of this expanded range. Conversely, a greater slope angle (for example 60 degrees) at the bottom of the groove would decrease the range of edge thickness variations among objects which could be accommodated within a frame or mounting of given wall thickness and would simultaneously increase the vectored portion of the spring load force of the retainer bearing against the undersurface of the object being mounted.

Spring characteristics of the resilient prestressed wire 50 utilized for retainer function are a major factor in determining the minimum practical angular slope 62 at the bottom of the groove 30, consistent with the degree of mounting security for the object 40 considered acceptable in each application. As a practical matter, the diameter 51 of the round cross-section spring wire 50 used for a retainer must be proportioned to the size of the object 50 to be mounted, to assure ease of loading and unloading without the use of special tools and for reasons of appearance and control of costs. Whereas the working range of edge thickness dimensions of objects to be mounted increases in proportion to retainer spring wire diameter, weight and resulting cost of precious metal materials increases at an even greater rate. In addition, required wall thickness of the frame or mounting increases in proportion to increases in slope angle at the bottom of the groove for a given range of adjustment for edge thickness variations in objects to be mounted. Again, weight, cost of precious metals (if used) together with general bulk and asthetics of design must be considered in the selection of optimum overall dimensional specifications for each specific type of frame or mounting. Tradeoffs between diameter of wire retainers used and slope angle of the groove must be made to achieve the desired range of maximum-to-minimum edge thickness dimensions of objects which can be successfully installed in a frame or mounting of single standard dimensions.

An additional improvement in the design of the interior of the frame 10 involves the creation of an improved design for lower wall edge 36 of the groove 30 furthest removed from the coin or medallion 40. As shown in FIG. 4, if the lower wall edge 36 of the groove 30 furthest removed from the object being mounted 40 is straight, substantially parallel to the lower surface 44 of the object 40, and if said straight lower wall edge 36 extends for a length at least approximately equal to 10 percent of the diameter 51 of the round spring wire retainer 50 to be employed, thereby constituting the overall minimum depth portion of the groove 30, then heavy pressure applied against the upper surface 42 of the coin or medallion 40 in an attempt to force it out of the frame 10 will not dislodge the wire retainer 50 and will not allow the object 40 to escape the frame 10. This will be true provided that the wire retainer 50 has been presized to cause the open ends of the same to abut when the retainer 50 is compressed to the point where forced against the aforesaid straight horizontal lower wall 36 of the groove 30. In the case of a multiplicity of retainers used in other configurations such as rectangular or oval, the respective ends of adjacent retainers must be caused to abut in this fashion.

Figure 9:
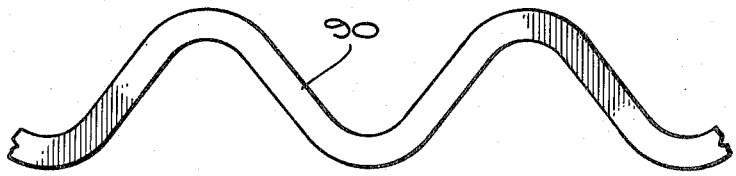
FIG. 9 is an enlarged fragmentary detailed view of a corrugated shim.

The present invention also incorporates the optional use of an improved corrugated shim 90, shown in the enlarged fragmentary side detailed view of FIG. 9. Variations in perimeter dimensions such as diameter, length or width of a coin or medallion 40 to be retained in a frame 10 of a single dimension can be compensated for by use of the special shim design, formed in a wavy, corrugated pattern and made of spring metal. By this improved design, actual working thickness of the shim 90 varies as it can be stretched thinner for a tightly fitting object 40 and expand to a thickner shim for a loosely fitting object 40. Therefore, the effective working dimension of the shim 90 is widely variable to compensate for a range of variations which may be encountered in perimeter dimensions of the object 40 to be mounted within the fixed perimeter of the standard frame or mounting 10. Whereas the perimeter of the critical dimension inner wall 28 of the frame 10 is standardly sized to receive objects at the maximum end of the preprogrammed size range, the corrugated shim 90 is employed only in those instances where objects of significantly less than maximum perimeter dimensions are to be mounted. Because it is extremely undesirable to mount an object in a frame or mounting where the object is loosely held and is free to move after the installation is complete, it is therefore desirable to assure a snug fit between the perimeter dimensions of the frame or mounting and the object to be installed therein. Whereas conventional shimming techniques involve the use of a series of shim stock, often of varying thicknesses to compensate for the specific dimensional differences encountered in each particular installation, the present invention incorporates a single shim of special design to accommodate a full preprogrammed range of dimensional variations between perimeter dimensions of standard sized frames or mountings and the particular perimeter dimensions of the object or objects which these frames and mountings are designed to receive.

Figure 2:
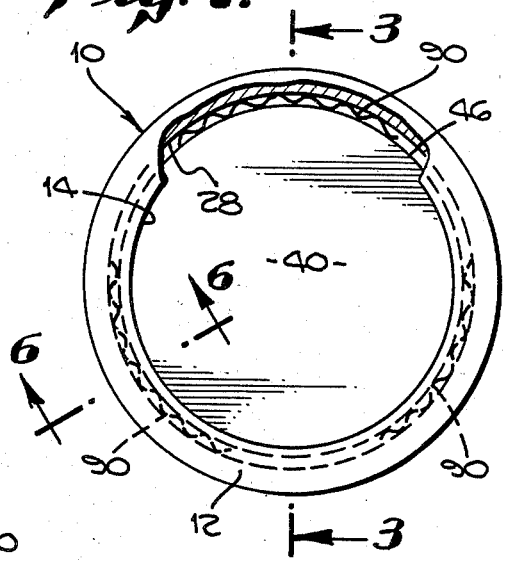
FIG. 2 is a top plan view of the assembled apparatus, partially broken away to show a shim in place, with two shims shown in phantom.

In order to achieve an even distribution and centering of the undersized object 40 within the frame 10, a multiplicity of corrugated shims 90 may be used. This is illustrated in the exploded perspective view in FIG. 1. The shims 90 in place inside the frame 10 and surrounding the undersized coin or medallion 40 are shown in FIG. 2. The shims 90 fit in the gap between the perimeter 46 of the undersized coin or medallion 40 and the critical dimension inner wall 28 of the frame 10. In a circular configuration as illustrated, three shims 90 ideally distribute the object 40 so that it is centered within the frame 10. The corrugated design of the shim 90 accommodates a wide range of gap thicknesses. If there is a large gap, each shim 90 is not significantly compressed and serves to fill the entire width of the gap. If the gap is narrow, each shim can be compressed to the desired amount (thereby becoming longer) until the thickness of the shim equals the gap thickness. The corrugated design allows for this accordian effect which enables the shim 90 to accommodate a multiplicity of gap thicknesses and therefore a multiplicity of different perimeter dimensions of the object 40 to be retained within the standard sized frame 10. The shim 90 can be made of thin flexible spring metal such as phosphor bronze or spring gold.

It should be recognized that the use of one or more corrugated shim segments is purely optional and is dependent upon the precise size and shape of the object to be mounted together with the embossed design thereof. In practice, the object 40 is first mounted using the retainer(s) 50 alone and without shims 90, to observe the amount of vectored force action of the retainers (50) applied against the surface of the object 40. In many cases, this force is sufficient to properly secure undersize objects 40 within the frame 10 without shimming. Whereas the object 40 may be firmly held, however, it may appear off center when viewed from its face 42 and this detracts from the finished appearance. If the object 40 is improperly secured and/or off center when viewed, the corrugated shim stock 90 will be utilized to correct these conditions.

Figure 10:
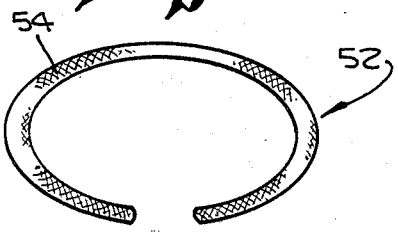
FIG. 10 is a perspective view of the improved circular retaining wire having a slightly knurled or textured surface.

It has been discovered that for a circular configuration if the lower surface 44 or rim edge 46 of the object 40 to be mounted is smooth and the surface of spring retaining ring 50 is also smooth, it is yet possible that the object 40 can itself rotate inside the frame 10. In order to impede rotation, an improved retaining ring design as shown in FIG. 10 has been created. The improved retaining ring 52 has a slightly roughened or knurled surface 54. By having this roughened or knurled surface 54, a friction effect is created between the improved retaining ring 52 and the lower surface 44 or rim edge surface 46 of the object 40. This friction effect serves to impede rotation of the object 40 within the frame 10.

Figure 3:
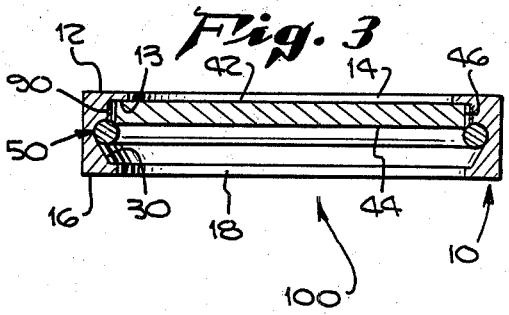
FIG. 3 is a cross-sectional view of the retaining frame and its components, taken along line 3—3 of FIG. 2.

A cross-sectional view of the completed assembly 100 is shown in FIG. 3. As previously discussed, the present invention is not limited to objects of circular configuration mounted in cylindrical frames. The sloping wall of the groove 30 with its deepest point 32 adjacent its uppermost portion 33 and its height 64 substantially greater than the diameter 51 of the retainer being used 50 is applicable to other configurations such as square, rectangular, oval, and polygonal, to accommodate a multiplicity of object thicknesses. As shown in U.S. Pat. No. 4,283,831, FIGS. 17 and 18, two retaining wires are necessary for designs of rectangular or oval configuration. The use of one or more flexible corrugated shims 90 to compensate for undersized objects within the standard sized frame is also applicable to these other shapes.

Therefore, the invention also relates to an improved rectangular shaped frame for holding an object of rectangular cross-section in its upper portion so that the upper face of the rectangular object shows through an opening in the upper surface of the rectangular frame and for retaining the rectangular object in place by means of two rectangular shaped open ended resilient prestressed retaining wires whose corresponding open ends face one another, wherein the cross-section of each wire is round, and where each wire exerts a centrifugal force when inserted into a groove which extends along the entire inner circumferential wall along the lower portion of the rectangular frame such that the corresponding open-ends of each wire face one another, whereby a vertical force component from each rectangular shaped open ended prestressed retaining wire having a round cross-section against the lower surface at or near the perimeter area of the rectangular object serves to retain the rectangular object in place and a horizontal force component from each rectangular shaped wire serves to retain the wire within the groove in the lower portion of the inner frame wall.

The groove has a height substantially greater than the diameter of each of said rectangular shaped open-ended resilient prestressed retaining wires. The groove has a smooth side wall which is tapered along the height of the groove wherein the groove is at a uniform angle such that its deepest point is adjacent its uppermost portion. The lower wall edge of said groove furthest removed from the retained rectangular object being substantially straight and substantially parallel to the lower surface of the object being retained and extending for a length at least approximately equal to 10 percent of the diameter of each of said rectangular open-ended resilient prestressed retaining wires. Each of said rectangular open ended resilient prestressed retaining wires is presized such that their corresponding open ends which face each other will abut when the retaining wires are compressed to the point where they are forced against said lower wall edge of said groove. Therefore, the geometry of said groove will automatically permit each of said rectangular open ended resilient prestressed retaining wires to position themselves against the lower surface at or near the perimeter of the rectangular object being retained and will permit each of said rectangular open ended resilient prestressed retaining wires to simultaneously vector a portion of the spring preload against the object while another vector portion of the spring preload from each wire will serve to secure each retaining wire within the groove, thereby enabling one standard size frame to accommodate similarly shaped objects within a range of differing thicknesses and assuring that the rectangular object will remain inside the frame even if substantial force is applied to the upper surface of the rectangular object.

Therefore, the invention also relates to an improved oval shaped frame for holding an object of oval cross-section in its upper portion so that the upper face of the oval object shows through an opening in the upper surface of the oval frame and for retaining the oval object in place by means of two semi-oval shaped open ended resilient prestressed retaining wires whose corresponding open ends face one another, wherein the cross-section of each wire is round, and where each wire exerts a centrifugal force when inserted into a groove which extends along the entire inner circumferential wall along the lower portion of the oval frame such that the corresponding open-ends of each wire face one another, whereby a vertical force component from each semi-oval shaped open ended prestressed retaining wire having a round cross-section against the lower surface at or near the perimeter area of the oval object serves to retain the oval object in place and a horizontal force component from each oval shaped wire serves to retain the wire within the groove in the lower portion of the inner frame wall.

The groove has a height substantially greater than the diameter of each of said semi-oval shaped open-ended resilient prestressed retaining wires. The groove has a smooth side wall which is tapered along the height of the groove wherein the groove is at a uniform angle such that its deepest point is adjacent is uppermost portion. The lower wall edge of said groove furthest removed from the retained oval object being substantially straight and substantially parallel to the lower surface of the object being retained, and extending for a length at least approximately equal to 10 percent of the diameter of each of said semi-oval open-ended resilient prestressed retaining wires. Each of said semi-oval open ended resilient prestressed retaining wires is presized such that their corresponding open ends which face each other will abut when the retaining wires are compressed to the point where they are forced against said lower wall edge of said groove. Therefore, the geometry of said groove will automatically permit each of said semi-oval open ended resilient prestressed retaining wires to position themselves against the lower surface at or near the perimeter of the oval object being retained and will permit each of said semi-oval open ended resilient prestressed retaining wires to simultaneously vector a portion of the spring preload against the object while another vector portion of the spring preload from each wire will serve to secure each retaining wire within the groove, thereby enabling one standard size frame to accommodate similarly shaped objects within a range of differing thicknesses and assuring that the oval object will remain inside the frame even if substantial force is applied to the upper surface of the oval object.

As previously discussed, the improved frame design can be accomplished by many methods such as casting, machining, extruding, die striking or any other comparable manufacturing method. The frame 10 is usually made of precious metal such as gold, silver, or platinum, but other metals such as steel, aluminum, brass or tin can be used. The retaining means 50 is usually made of spring steel, but other metals can be used. The flexible corrugated shim 90 can be made of phoshor bronze, spring steel or comparable metals.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the methods shown are intended only for illustration and for disclosure of an operative embodiment and not to show all of the various forms of modification in which the invention might be embodied.

The invention has been described in considerable detail by providing a disclosure of at least one of its forms. However, such detailed description is not intended in any way to limit the broad features or principles of the invention, or the scope of patent monopoly to be granted.

What is claimed is:

1. An improved frame for holding and retaining an object, wherein the improved frame is characterized by an upper portion and a lower portion, the upper portion containing an upper face having a central hole for exposing the upper surface of the object, the lower portion containing a lower face having a large central hole, wherein the object is held in the frame's upper portion so that the upper face of the object shows through the opening in the upper surface of the frame and wherein the object is retained in place by means of an open ended resilient prestressed retaining wire having a round cross-section which exerts a centrifugal force when inserted into a groove which extends along the entire inner circumferential wall along the lower portion of the frame such that the uppermost portion of the groove is adjacent the upper portion of the frame and also adjacent the lower surface of the retained object and the lowermost portion of the groove is adjacent the lower face of the frame, whereby a vertical force component from the open ended prestressed retaining wire having a round cross-section against the lower surface at or near the perimeter area of the object serves to retain the object in place and a horizontal force component from the retaining wire serves to retain the wire within the groove in the lower portion of the inner frame wall, wherein the improvement comprises:

a. said groove having a cross-sectional height substantially greater than the diameter of said open ended resilient prestressed retaining wire;

b. said groove having a smooth side wall which is tapered along the cross-sectional height of the groove wherein the groove is at a uniform angle such that it becomes progressively deeper along its tapered portion and such that its deepest point is adjacent its uppermost portion;

c. the lower wall edge of said groove furthest removed from the retained object being substantially straight and substantially parallel to the lower surface of the object being retained, an extending for a length at least approximately equal to 10 percent of the diameter of said open ended resilient prestressed retaining wire; and d. said open ended resilient prestressed retaining wire being presized such that its open ends will abut when the retaining wire is compressed to the point where forced against said lower wall edge of said groove;

e. whereby the geometry of said groove will automatically permit said open ended resilient prestressed retaining wire to simultaneously vector a portion of the spring preload against the object while another vector portion of the spring preload will serve to secure the retaining wire within the groove, thereby enabling one standard size frame to accommodate similarly shaped objects within a range of differing thicknesses and assuring that the object will remain inside the frame even if substantial force is applied to the upper surface of the object.

2. The invention as defined in claim 1 wherein said cross-sectional height of said groove is at least double the diameter of said open ended resilient prestressed retaining wire having a round cross-section.

3. The invention as defined in claim 1 wherein the uniform angle of said groove is between a range from approximately 30 degrees relative to the vertical to approximately 60 degrees relative to the vertical when the frame is held such that its upper and lower faces are horizontal.

4. The invention as defined in claim 1 wherein the penetration of said open ended resilient prestressed retaining wire having a round cross-section into said groove is between a range from approximately 25 percent of the diameter of the wire to approximately 75 percent of the diameter of the wire.

5. The invention as defined in claim 1 wherein the object is a coin or medallion.

6. The invention as defined in claim 1 wherein the frame is made of gold.

7. The invention as defined in claim 1 wherein the frame is made of silver.

8. An improved frame for retaining one of a multiplicity of similarly shaped objects of differing thicknesses, wherein the improved frame is characterized by an upper face having a central hole for exposing the upper surface of the object, a lower face having a large central hole, an inner transverse circumferential wall containing a transverse critical dimension inner wall portion adjacent the upper face which surrounds a portion of the perimeter of the object retained within the improved frame, the circumference of the critical dimension inner wall being only slightly larger than the corresponding circumference of the object to be retained within it, and a groove which extends along the entire inner transverse circumferential wall and beneath the critical dimension inner wall such that the uppermost portion of the groove is adjacent the critical dimension inner wall and also adjacent the lower surface of the retained object and the lowermost portion of the groove is adjacent the lower face of the frame, and an open ended resilient prestressed retaining wire of round cross-section which is accommodated within the groove for retaining the object in place inside the frame, wherein the improvement comprises:

a. said groove having a cross-sectional height substantially greater than the diameter of said open ended resilient prestressed retaining wire;

b. said groove having a smooth side wall which is tapered along the cross-sectional height of the groove wherein the groove is at a uniform angle such that it becomes progressively deeper along its tapered portion and such that its deepest point is adjacent its uppermost portion;

c. the lower wall edge of said groove furthest removed from the retained object being substantially straight and substantially parallel to the lower surface of the object being retained, and extending for a length at least approximately equal to 10 percent of the diameter of said open ended resilient prestressed retaining wire; and d. said open ended resilient prestressed retaining wire being presized such that its open ends will abut when the retaining wire is compressed to the point where forced against said lower wall edge of said groove;

e. whereby the geometry of said groove will automatically permit said open ended resilient prestressed retaining wire to position itself against the lower surface at or near the perimeter of the object being retained and will permit said open ended resilient prestressed retaining wire to simultaneously vector a portion of the spring preload against the object while another vector portion of the spring preload will serve to secure the retaining wire within the groove, thereby enabling one standard size frame to accommodate similarly shaped objects within a range of differing thicknesses and assuring that the object will remain inside the frame even if substantial force is applied to the upper surface of the object.

9. An improved cylindrical frame for holding and retaining an object of circular cross-section, wherein the improved cylindrical frame is characterized by an upper portion and a lower portion, the upper portion containing an upper face having a central hole for exposing the upper surface of the circular object, the lower portion containing a lower face having a large central hole, wherein the circular object is held in the cylindrical frame's upper portion so that the upper face of the circular object shows through the opening in the upper surface of the cylindrical frame and wherein the circular object is retained in place by means of a circular open ended resilient prestressed retaining wire having a round cross-section which exerts a centrifugal force when inserted into a groove which extends along the entire inner circumferential wall along the lower portion of the cylindrical frame such that the uppermost portion of the groove is adjacent the upper portion of the frame and also adjacent the lower surface of the retained circular object and the lowermost portion of the groove is adjacent the lower face of the cylindrical frame, whereby a vertical force component from the circular open ended prestressed retaining wire having a round cross-section against the lower surface at or near the perimeter area of the circular object serves to retain the circular object in place and a horizontal force component from the circular retaining wire serves to retain the wire within the groove in the lower portion of the inner frame wall, wherein the improvement comprises:

a. said groove having a cross-sectional height substantially greater than the diameter of said circular open ended resilient prestressed retaining wire;

b. said groove having a smooth side wall which is tapered along the cross-sectional height of the groove wherein the groove is at a uniform angle such that it becomes progressively deeper along its tapered portion and such that its deepest point is adjacent its uppermost portion;

c. the lower wall edge of said groove furthest removed from the retained circular object being substantially straight and substantially parallel to the lower surface of the object being retained and extending for a length at least approximately equal to 10 percent of the diameter of said circular open ended resilient prestressed retaining wire; and d. said circular open ended resilient prestressed retaining wire being presized such that its open ends will abut when the retaining wire is compressed to the point where forced against said lower wall edge of said groove;

e. whereby the geometry of said groove will automatically permit said circular open ended resilient prestressed retaining wire to position itself against the lower surface at or near the perimeter of the circular object being retained and will permit said circular open ended resilient prestressed retaining wire to simultaneously vector a portion of the spring preload against the object while another vector portion of the spring preload will serve to secure the retaining wire within the groove, thereby enabling one standard size frame to accommodate similarly shaped objects within a range of differing thicknesses and assuring that the circular object will remain inside the frame even if substantial force is applied to the upper surface of the circular object.

10. An improved rectangular shaped frame for holding and retaining an object of rectangular cross-section, wherein the improved rectangular frame is characterized by an upper portion and a lower portion, the upper portion containing an upper face having a central hole for exposing the upper surface of the rectangular object, the lower portion containing a lower face having a large central hole, wherein the rectangular object is held in the rectangular frame's upper portion so that the upper face of the rectangular object shows through the opening in the upper surface of the rectangular frame and wherein the rectangular object is retained in place by means of two rectangular shaped open ended resilient prestressed retaining wires whose corresponding open ends face one another, wherein the cross-section of each wire is round, and where each wire exerts a centrifugal force when inserted into a groove which extends along the entire inner circumferential wall along the lower portion of the rectangular frame such that the uppermost portion of the groove is adjacent the upper portion of the rectangular frame and also adjacent the lower surface of the retained rectangular object and the lowermost portion of the groove is adjacent the lower face of the rectangular frame, wherein the two retaining wires are inserted into the groove such that the corresponding open ends of each wire face one another, whereby a vertical force component from each rectangular shaped open ended prestressed retaining wire having a round cross-section against the lower surface at or near the perimeter area of the rectangular object serves to retain the rectangular object in place and a horizontal force component from each rectangular shaped wire serves to retain the wires within the groove in the lower portion of the inner frame wall, wherein the improvement comprises:

a. said groove having a cross-sectional height substantially greater than the diameter of each of said rectangular shaped open-ended resilient prestressed retaining wires;

b. said groove having a smooth side wall which is tapered along the cross-sectional height of the groove wherein the groove is at a uniform angle such that it becomes progressively deeper along its tapered portion and such that its deepest point is adjacent its uppermost portion;

c. the lower wall edge of said groove furthest removed from the retained rectangular object being substantially straight and substantially parallel to the lower surface of the object being retained, and extending for a length at least approximately equal to 10 percent of the diameter of each of said rectangular open-ended resilient prestressed retaining wires; and d. each of said rectangular open ended resilient prestressed retaining wires being presized such that their corresponding open ends which face each other will abut when the retaining wires are compressed to the point where they are forced against said lower wall edge of said groove;

e. whereby the geometry of said groove will automatically permit each of said rectangular open ended resilient prestressed retaining wires to position themselves against the lower surface at or near the perimeter of the rectangular object being retained and will permit each of said rectangular open ended resilient prestressed retaining wires to simultaneously vector a portion of the spring preload against the object while another vector portion of the spring preload from each wire will serve to secure each retaining wire within the groove, thereby enabling one standard size frame to accommodate similarly shaped objects within a range of differing thicknesses and assuring that the rectangular object will remain inside the frame even if substantial force is applied to the upper surface of the rectangular object.

11. An improved oval shaped frame for holding and retaining an object of oval cross-section, wherein the improved oval frame is characterized by an upper portion and a lower portion, the upper portion containing an upper face having a central hole for exposing the upper surface of the oval object, the lower portion containing a lower face having a large central hole, wherein the oval object is held in the oval frame's upper portion so that the upper face of the oval object shows through the opening in the upper surface of the oval frame and wherein the oval object is retained in place by means of two semi-oval shaped open ended resilient prestressed retaining wires whose corresponding open ends face one another, wherein the cross-section of each wire is round, and where each wire exerts a centrifugal force when inserted into a groove which extends along the entire inner circumferential wall along the lower portion of the oval frame such that the uppermost portion of the groove is adjacent the upper portion of the oval frame and also adjacent the lower surface of the retained oval object and the lowermost portion of the groove is adjacent the lower face of the oval frame, wherein the two semi-oval retaining wires are inserted into the groove such that the corresponding open ends of each wire face one another, whereby a vertical force component from each semi-oval shaped open ended prestressed retaining wire having a round cross-section against the lower surface at or near the perimeter area of the oval object serves to retain the oval object in place and a horizontal force component from each semi-oval shaped wire serves to retain the wires within the groove in the lower portion of the inner frame wall, wherein the improvement comprises:

a. said groove having a cross-sectional height substantially greater than the diameter of each of said semi-oval shaped open-ended resilient prestressed retaining wires;

b. said groove having a smooth side wall which is tapered along the cross-sectional height of the groove wherein the groove is at a uniform angle such that it becomes progressively deeper along its tapered portion and such that its deepest point is adjacent its uppermost portion;

c. the lower wall edge of said groove furthest removed from the retained oval object being substantially straight and substantially parallel to the lower surface of the object being retained, and extending for a length at least approximately equal to 10 percent of the diameter of each of said semi-oval open-ended resilient prestressed retaining wires; and d. each of said semi-oval open ended resilient prestressed retaining wires being presized such that their corresponding open ends which face each other will abut when the retaining wires are compressed to the point where they are forced against said lower wall edge of said groove;

e. whereby the geometry of said groove will automatically permit each of said semi-oval open ended resilient prestressed retaining wires to position themselves against the lower surface at or near the perimeter of the oval object being retained and will permit each of said semi-oval open ended resilient prestressed retaining wires to simultaneously vector a portion of the spring preload against the object while another vector portion of the spring preload from each wire will serve to secure each retaining wire within the groove, thereby enabling one standard size frame to accommodate similarly shaped object within a range of differing thicknesses and assuring that the oval object will remain inside the frame even if substantial force is applied to the upper surface of the oval object.

* * * * *